US006577206B2

(12) United States Patent
Ikeda

(10) Patent No.: US 6,577,206 B2
(45) Date of Patent: Jun. 10, 2003

(54) CONVERTER FOR SATELLITE BROADCAST RECEPTION WITH AN EXTERNALLY HELD PROBE

(75) Inventor: Tomoki Ikeda, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/837,014

(22) Filed: Apr. 18, 2001

(65) Prior Publication Data

US 2001/0033205 A1 Oct. 25, 2001

(30) Foreign Application Priority Data

Apr. 20, 2000 (JP) ..... 2000-126242

(51) Int. Cl.[7] ..... H01P 5/103
(52) U.S. Cl. ..... 333/26; 333/248
(58) Field of Search ..... 333/26, 21 A, 333/248

(56) References Cited

U.S. PATENT DOCUMENTS 3,925,883 A 12/1975 Cavalear ..... 29/600
4,058,813 A 11/1977 Risko ..... 343/786
5,585,768 A * 12/1996 Wei ..... 333/26 X
6,018,276 A * 1/2000 Hirota et al. ..... 333/26

FOREIGN PATENT DOCUMENTS

| | | | | |
|---|---|---|---|---|
| DE | 1 616 800 | | 4/1971 | |
| EP | 1 091 443 A2 | | 4/2001 | |
| GB | 2 334 153 A | | 8/1999 | |
| JP | 207002 | * | 9/1987 | ..... 333/26 |
| JP | 11-017573 | | 1/1999 | |
| JP | 11-074809 | | 3/1999 | |

* cited by examiner

*Primary Examiner*—Benny Lee
(74) *Attorney, Agent, or Firm*—Brinks Hofer Gilson & Lione

(57) ABSTRACT

A converter for satellite broadcast reception superior in productivity and inexpensive with reduced material cost is provided. In this converter, a waveguide is formed by bending a metallic plate and is integrally provided with a holding portion which is positioned outside the waveguide. An insulating portion of a probe is held by the holding portion.

8 Claims, 13 Drawing Sheets

CONVERTER FOR SATELLITE BROADCAST RECEPTION WITH AN EXTERNALLY HELD PROBE

BACKGROUND OF THE INVENTION

1. Field of the Invention

The present invention relates to a converter for satellite broadcast or communication reception to receive a circularly polarized wave comprising a vertically polarized wave and a horizontally polarized wave.

2. Description of the Prior Art

A conventional converter for satellite broadcast reception will be described below with reference to FIGS. 13 to 16, of which FIG. 13 is a perspective view of the conventional converter for satellite broadcast reception, FIG. 14 is a sectional view taken on line 14—14 in FIG. 13, FIG. 15 is an enlarged view of a principal portion, explaining a mounted state of a probe, and FIG. 16 is an enlarged view of a principal portion, showing a mounted state of a circuit board.

As best seen in FIGS. 13–14, a housing 31 and a waveguide 32 are formed integrally using a metallic material such as die-cast aluminum or zinc. The housing 31, which is formed in a generally rectangular box shape, comprises a bottom wall 31*a*, side walls 31*b* formed upright so as to enclose the bottom wall 31*a* while allowing an upper side to be open, a receptacle portion 31*c* enclosed with the side walls 31*b*, a vertical through hole 31*d* (see FIG. 15) formed in a position close to one end portion of the bottom wall 31*a*, and stepped portions 31*e* formed by cutting out peripheral edges of upper ends of the side walls 31*b*. The waveguide 32 is formed in a cylindrical shape relatively small in diameter and is projected from the bottom wall 31*a* at the position of the through hole 31*d*. The waveguide 32 comprises a generally cylindrical portion 32*b* having an opening 32*a* for introducing a polarized wave, a hollow portion 32*c* formed centrally in the longitudinal direction of the cylindrical portion, and a holding portion 32*d* formed as a semi-cylindrical recess within the cylindrical portion 32*b*, the holding portion 32*d* extending toward the opening 32*a* from a peripheral edge position of the through hole 31*d* formed in the housing 31, as shown in FIG. 15.

As best seen in FIG. 15, a probe 33 for catching a horizontally polarized wave is made up of a cylindrical insulating portion 33*a* formed of, for example, a fluorine resin, polyethylene, or Teflon, and a linear central conductor 33*b* piercing through the center of the insulating portion 33*a* and formed of a metal such as brass or nickel. The central conductor 33*b* has one end portion 33*c* which is bent approximately at right angles and an opposite end portion 33*d* which is rectilinear.

As shown in FIG. 16, a single rectangular circuit board 34 formed by an insulating board comprises a thin flat plate portion 34*a*, three vertical through holes 34*b* formed near a side edge of the flat plate portion 34*a*, bridge portions 34*d* and 34*e* which are formed in T shape, and a small hole 34*c* formed near the through hole 34*b*. A copper-clad earth conductor 35 is formed on a lower surface of the circuit board 34 except the lower surface portion where the bridge portion 34*e* is formed. A lower surface of the bridge portion 34*d* functions as a short-circuit rod for the probe 33.

A probe 36 for catching a vertically polarized wave is formed as a conductive pattern on an upper surface of the flat plate portion, extending from an intersecting point of the bridge portions 34*d* and 34*e* toward the flat plate portion 34*a*, and is connected to a circuit pattern (not shown) formed on an upper surface of the flat plate portion 34*a*. The through hole 31*d* formed in the housing 31 and the through holes 34*b* formed in the flat plate portion 34*a* are opposed to each other and the opposite end portion 33*d* of the central conductor 33*b* of the probe 33 is inserted through the hole 34*c* formed in the flat plate portion 34*a*. In this state the circuit board 34 of the above configuration placed on the bottom wall 31*a* of the housing 31 and is fixed by a suitable means. The opposite end portion 33*d* of the central conductor 33*b* projected above the circuit board 34 is soldered to a circuit pattern by solder 37.

As shown in FIG. 14, a short-circuit wall 38 is formed in a box shape using a metal such as die-cast aluminum or zinc and is secured to the circuit board 34 by a desired means, e.g., caulking, so as to cover the through holes 34*b* formed in the circuit board. A bottom portion 38*a* of the short-circuit wall 38 functions as a short-circuit portion for the probe 36.

A cover 39, which is constituted by a single rectangular metallic plate (see FIGS. 13 and 14), is placed on the stepped portions 31*e* (see FIG. 15) of the side walls 31*b* of the housing 31 and is fixed by a suitable means. The receptacle portion 31*c* (see FIG. 14) of the housing 31 is hermetically sealed and the interior thereof is shielded electrically.

In the conventional converter for satellite broadcast reception, however, since the waveguide 32 and the holding portion 32*d* are formed integrally by die-casting aluminum for example, the material cost is high and it takes a considerable time for the manufacture, that is, the productivity is poor.

Besides, since the holding portion 32*d* is formed (see FIG. 15), the mold used for die casting is complicated and expensive, thus giving rise to the problem that the converter becomes expensive.

Further, it is necessary that the insulating portion 33*a* of the probe 33 be press-fitted into the holding portion 32*d* of the waveguide 32; besides, the press-fitting work is performed in the hollow portion 32*c* which is narrow. Consequently, a considerable time is required for the manufacture, that is, the productivity is poor.

SUMMARY OF THE INVENTION

It is an object of the present invention to provide a converter for satellite broadcast reception which is superior in productivity and inexpensive.

According to the first means adopted by the present invention for solving the above-mentioned problems there is provided a converter for satellite broadcast reception, comprising a box-shaped metallic housing, a cylindrical waveguide, and a probe attached to the waveguide, the probe having a cylindrical insulating portion and a central conductor piercing through a central part of the insulating portion, the waveguide being formed by bending a metallic plate and being integrally provided with a holding portion positioned outside the waveguide to hold the insulating portion of the probe.

According to the second solving means adopted by the invention, the insulating portion of the probe is held grippingly by both an outer surface of the waveguide and the holding portion.

According to the third solving means adopted by the invention, the holding portion is provided with a retaining piece for locking a free end side of the holding portion to the waveguide.

According to the fourth solving means adopted by the invention, the holding portion covers the probe throughout the whole in the longitudinal direction of the insulating portion which is exposed from the waveguide.

According to the fifth solving means adopted by the invention, the holding portion covers the probe throughout the whole in the longitudinal direction of the central conductor which is exposed from the waveguide.

According to the sixth solving means adopted by the invention, the insulating portion with the central conductor installed therein is formed with a slot in the longitudinal direction thereof, and one end portion of the central conductor is bent along the slot.

According to the seventh solving means adopted by the invention, an outer surface of the insulating portion of the probe includes a flat surface, and the probe is held by the holding portion in an abutted state of the flat surface against an outer surface of the waveguide.

According to the eighth solving means adopted by the invention, the flat surface formed as a part of the outer surface of the insulating portion is perpendicular to an extending direction of one end of the central conductor, and the probe is held by the holding portion in an abutted state of the flat surface against the outer surface of the waveguide.

According to the ninth solving means adopted by the invention, an insertion hole for insertion therein of the central conductor is formed in the waveguide, and with the central conductor inserted into the insertion hole, the insulating portion of the probe is placed on the outer surface of the waveguide so as to straddle the insertion hole.

DETAILED DESCRIPTION OF PREFERRED EMBODIMENTS

Figure 1:
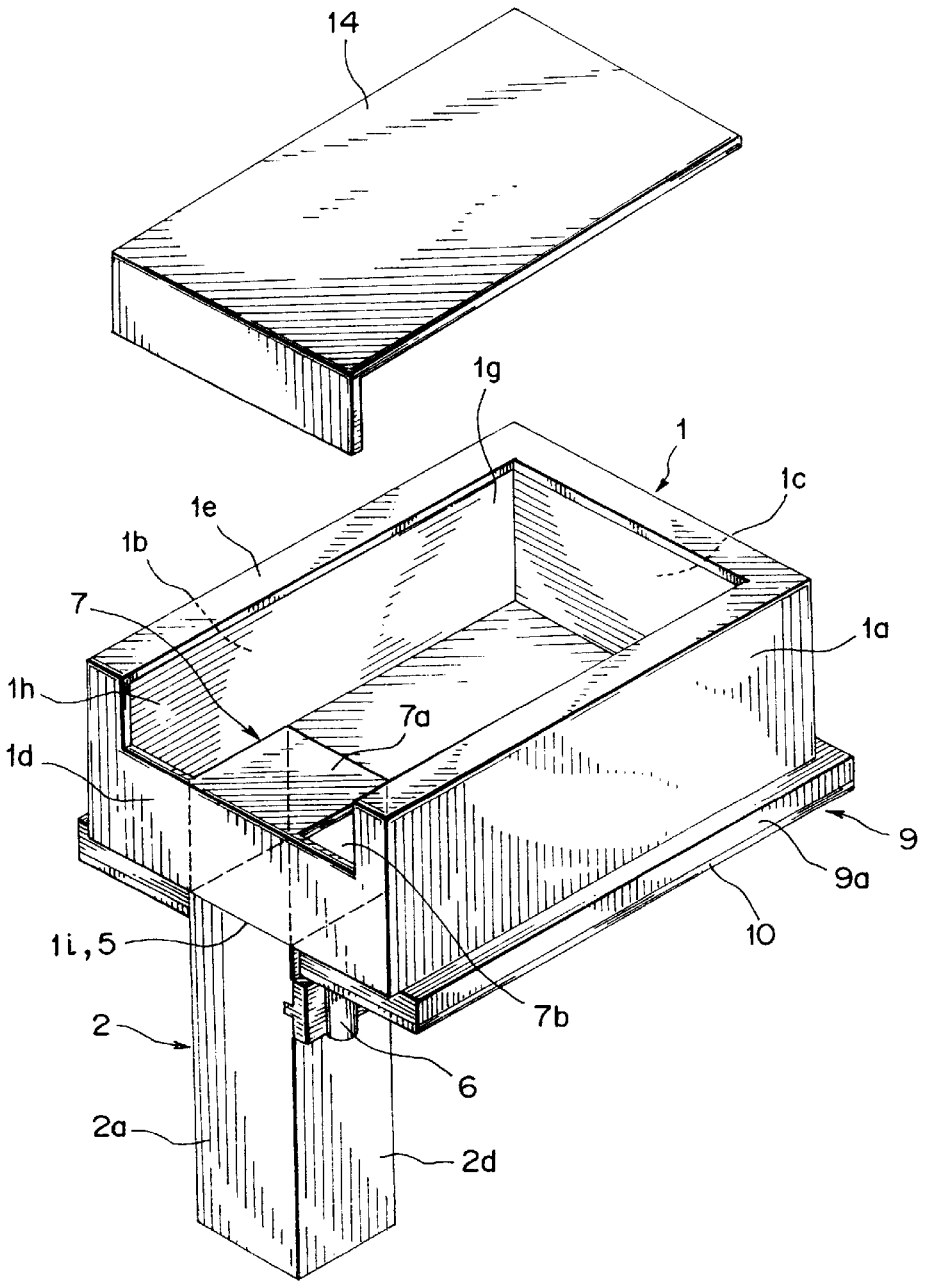
FIG. 1 is an exploded perspective view of a converter for satellite broadcast reception according to the first embodiment of the present invention.
Figure 2:
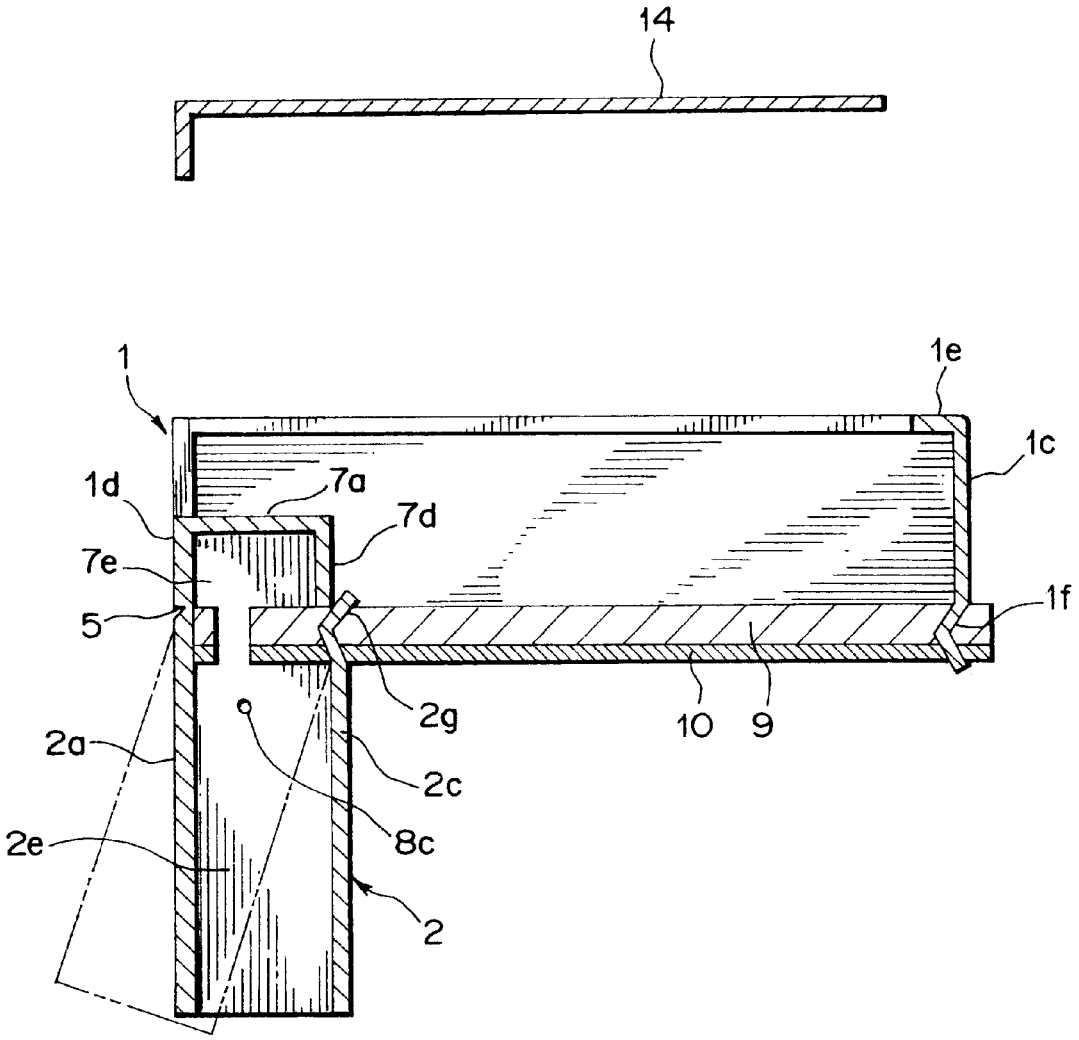
FIG. 2 is an exploded sectional view thereof.
Figure 3:
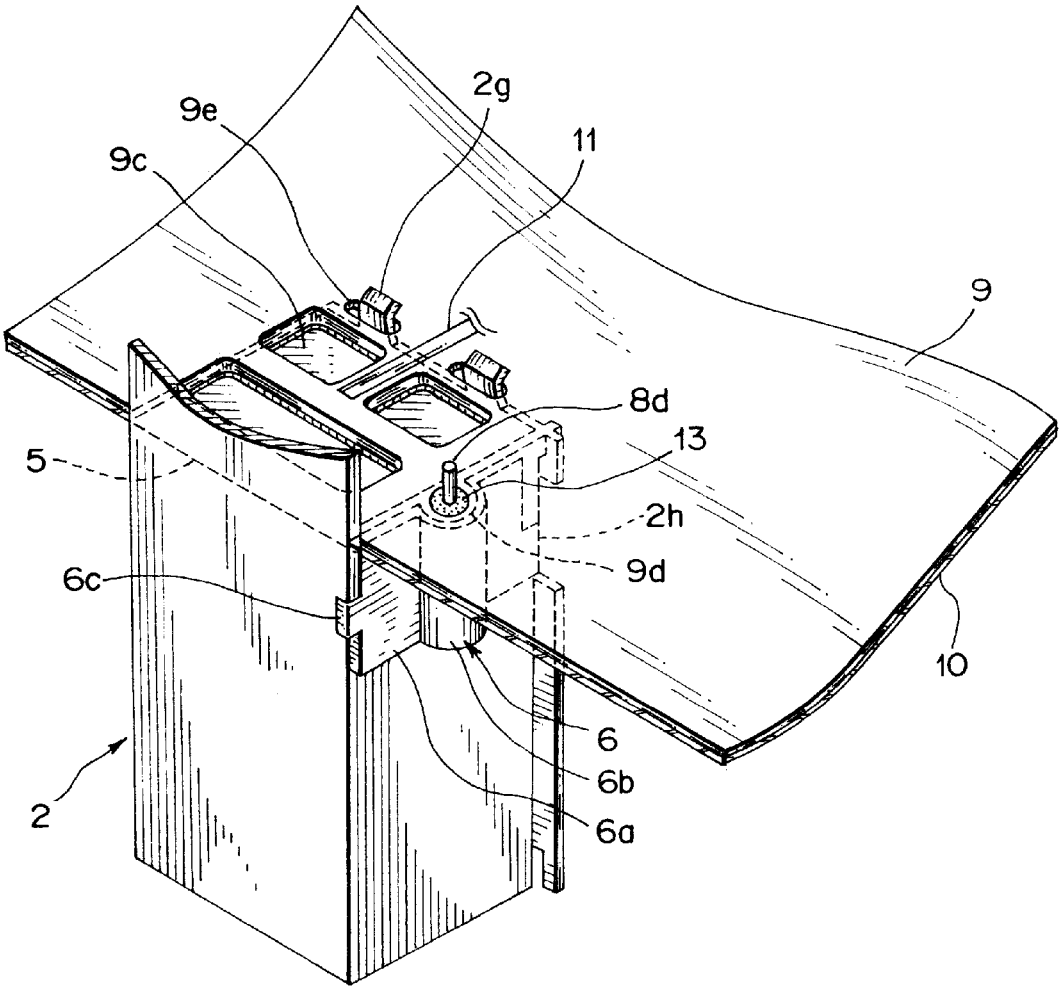
FIG. 3 is an explanatory diagram showing in what state a waveguide is mounted to a circuit board in the converter of the first embodiment.
Figure 4:
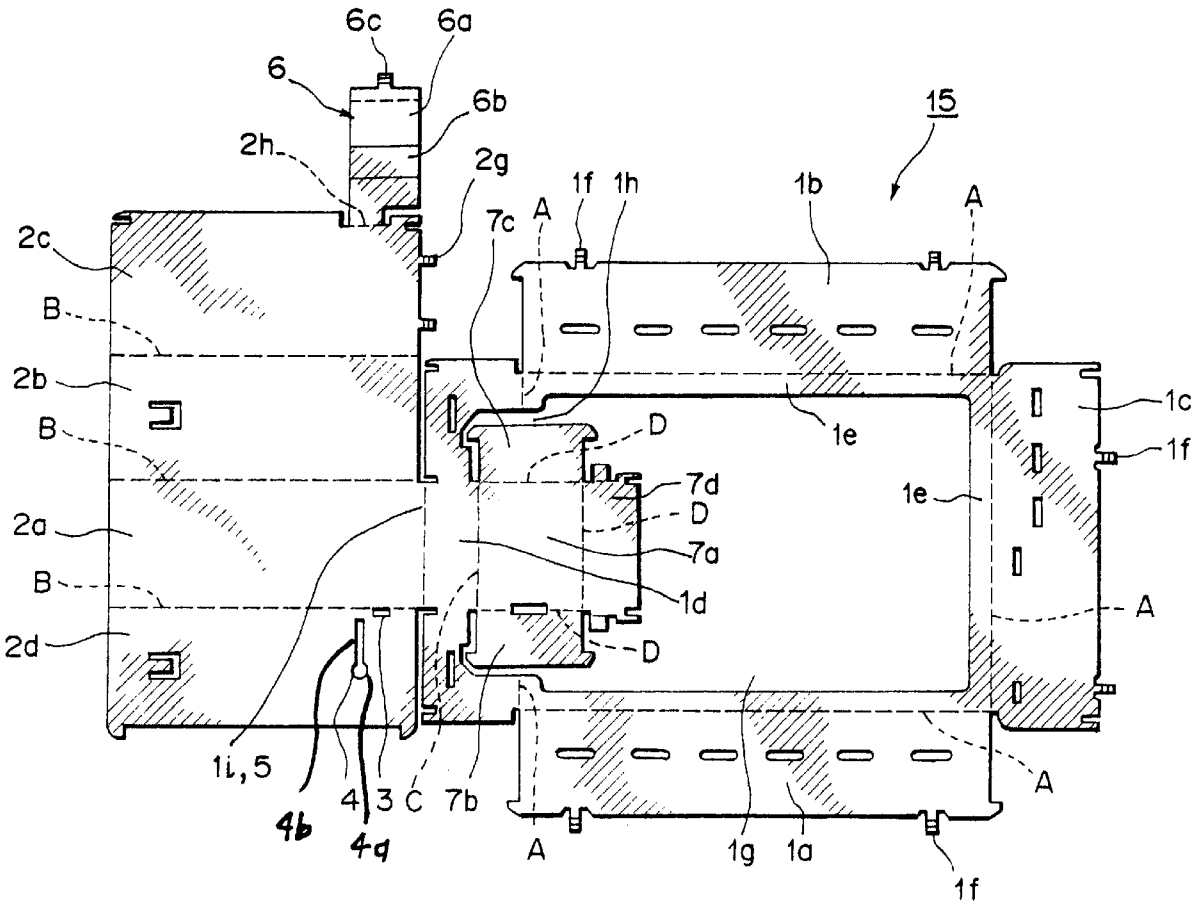
FIG. 4 is a developed view of semi-finished components, showing how to assemble the converter of the first embodiment.
Figure 5:
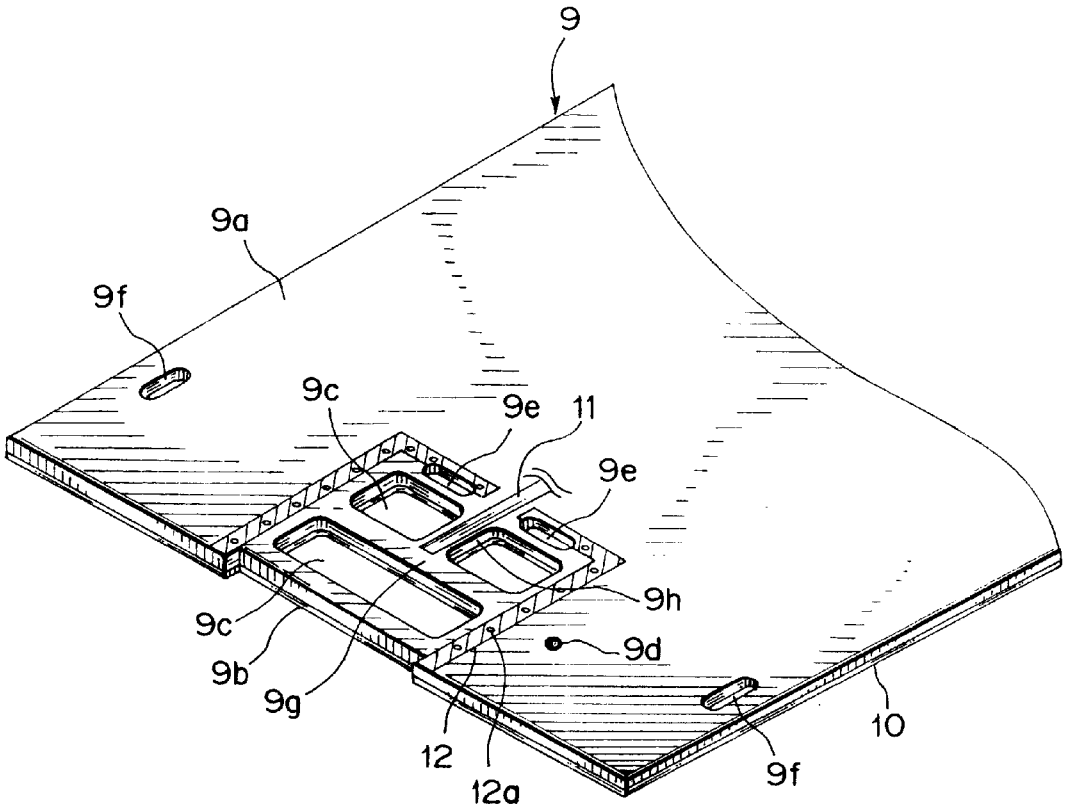
FIG. 5 is an enlarged view of the circuit board used in the converter of the first embodiment.
Figure 6:
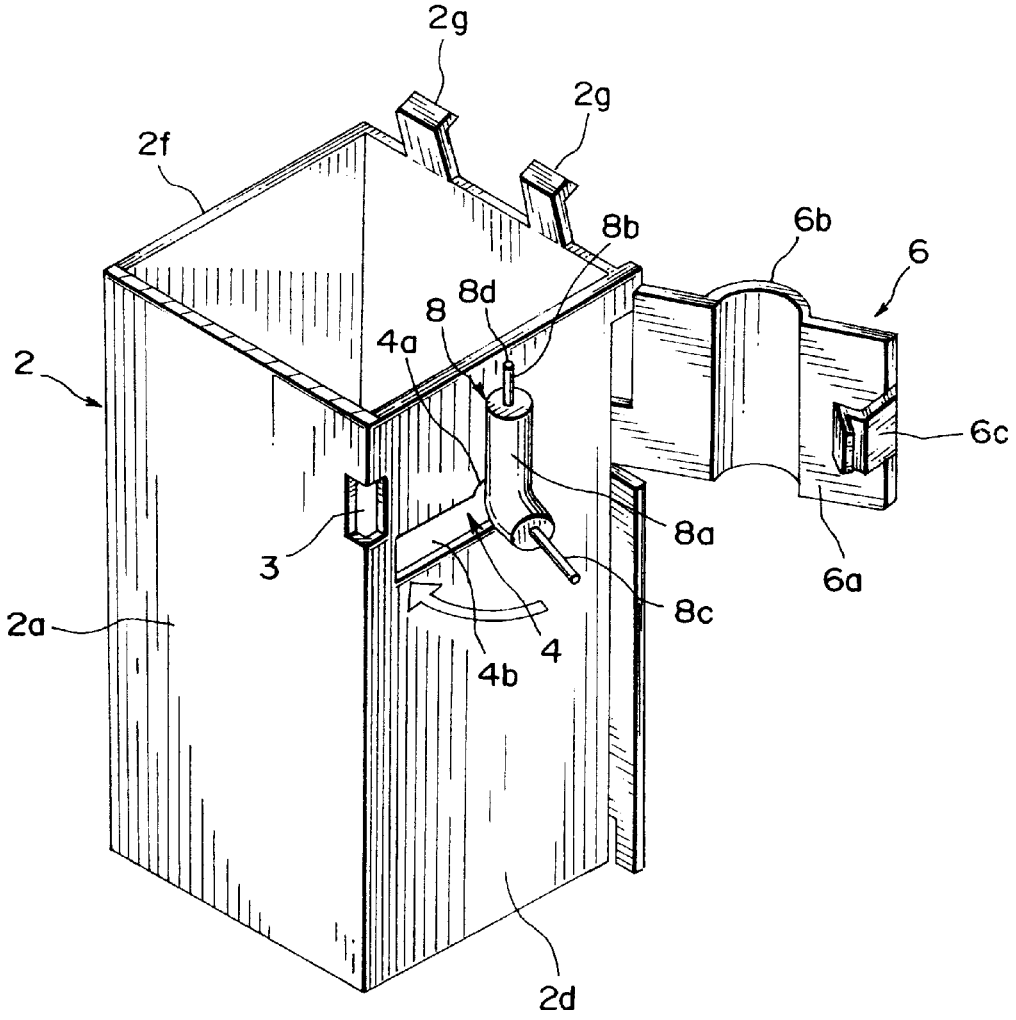
FIG. 6 is an explanatory diagram showing in what state a probe is mounted in the converter of the first embodiment.
Figure 7:
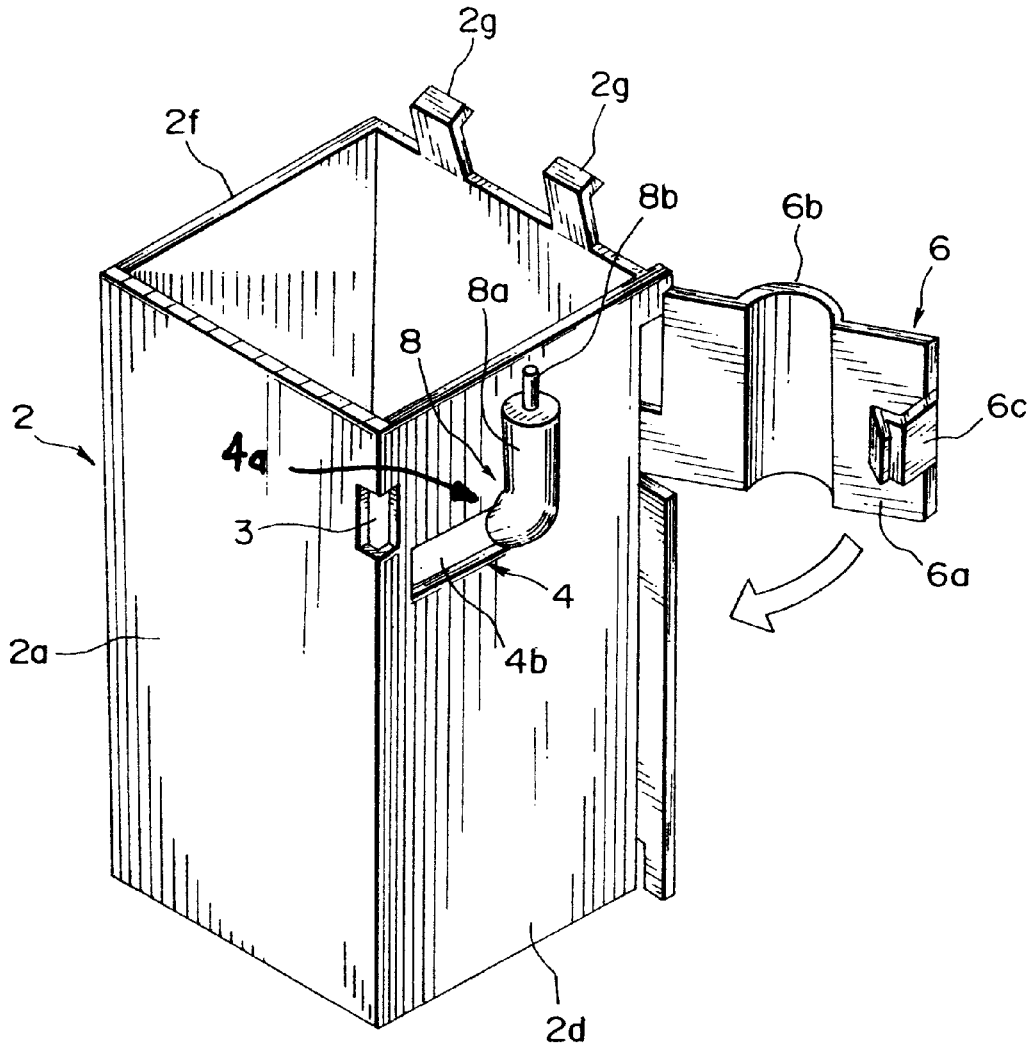
FIG. 7 is an explanatory diagram showing in what state the probe is mounted in the converter of the first embodiment.
Figure 8:
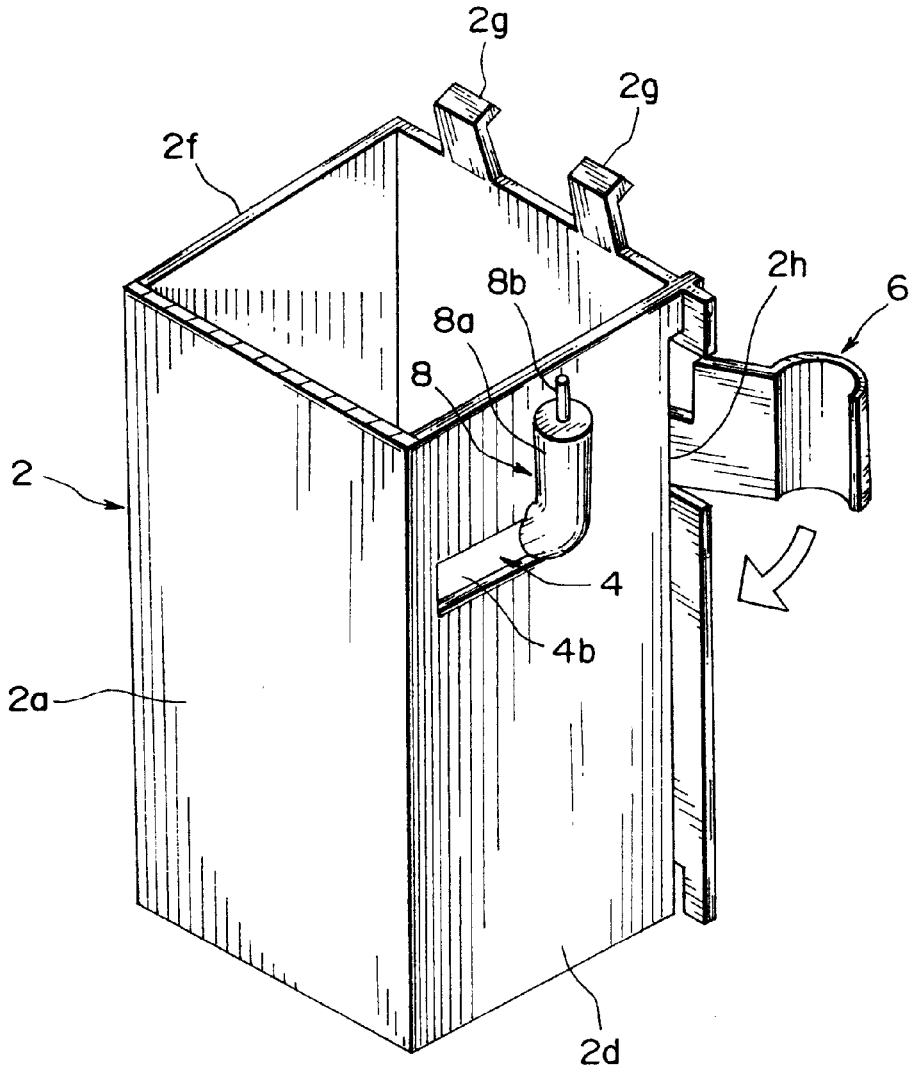
FIG. 8 is a perspective view showing a modified example of a holding member employable in the converter of the first embodiment.
Figure 9:
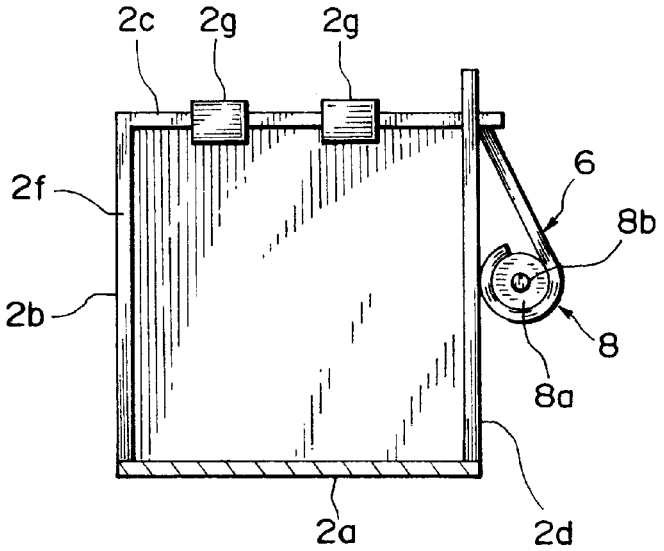
FIG. 9 is a top view thereof.

A converter for satellite broadcast reception according to the first embodiment of the present invention will be described below with reference to FIGS. 1 to 9, of which FIG. 1 is an exploded perspective view of the converter, FIG. 2 is an exploded sectional view thereof, FIG. 3 is an explanatory diagram showing in what state a waveguide is mounted to a circuit board, FIG. 4 is a developed view of semi-finished components, showing how to assemble the converter, FIG. 5 is an enlarged view of the circuit board, FIGS. 6 and 7 are explanatory diagrams showing in what state a probe is mounted, FIG. 8 is a perspective view showing a modified example of a holding member, and FIG. 9 is a top view thereof.

As best seen in FIG. 1, the converter for satellite broadcast reception according to the first embodiment of the present invention comprises a housing 1, a waveguide 2 and a short-circuit wall 7 which are connected together and formed integrally by bending a single thin metallic plate.

The housing 1, which is formed in a box shape using a thin metallic plate, comprises a ⊐-shaped upper wall 1*e* having a central rectangular hole 1*g* and a brim portion formed along an outer periphery of the hole 1*g*, and side walls 1*a*, 1*b*, 1*c* and 1*d* formed upright by bending the upper wall 1*e* on the four sides of the upper wall. The side walls 1*a* to 1*d* are integrally connected to the upper wall 1*e*. An upper portion of the side wall 1*d* opposed to the side wall 1*c* is formed with a large cutout portion 1*h* which is contiguous to the hole 1*g*. Further, as shown in FIG. 4, a plurality of generally <-shaped engaging pieces 1*f* are formed at a lower end of each of the side walls 1*a*, 1*b* and 1*c*.

The waveguide 2, which is formed in the shape of a rectangular parallelepiped using a thin metallic plate, comprises a side plate portion 2*a* connected to the side wall 1*d* of the housing 1 through a connecting portion 1*i* and extending downward, side plate portions 2*b* and 2*d* formed by bending the metallic plate at right angles on both sides of the side plate portion 2*a*, a side plate portion 2*c* (see FIG. 2) formed by bending the metallic plate at right angles from the side plate portion 2*b*, the side plate portion 2*c* being connected to the side plate portion 2*d* and opposed to the side plate portion 2*a*, a hollow portion 2*e* formed by being enclosed with the side plate portions 2*a* to 2*d*, and end portions 2*f* as free ends of the side plate portions 2*b* to 2*d* exclusive of the connecting portion 1*i*. As shown in FIGS. 2 and 3, two generally -shaped retaining pieces 2*g* are formed at the end 2*f* of the side plate portion 2*c* opposed to the side plate portion 2*a* which is connected to the housing 1. Further, as shown in FIG. 4, a generally rectangular engaging hole 3 is formed in the boundary between the side plate portions 2*a* and 2*d*, and an insertion hole 4 comprising a circular hole 4*a* and a rectangular hole 4*b* is formed in the side plate portion 2*d* at a position close to the engaging hole 3. In the connecting portion 1*i* between the side plate portion 2*a* and the side wall id of the housing 1 there is formed a bending facilitating means 5 such as a cut-in portion (see FIGS. 1–3). The waveguide 2, when formed by bending a thin metallic plate, is projected downward vertically from the housing 1, as shown in FIG. 1, and it is tiltable relative to the housing 1, centered on the bending facilitating means 5, as indicated with a dotted line in FIG. 2.

As shown in FIGS. 3 and 4, a holding member 6 is formed so as to be positioned outside the waveguide 2 and it is connected to the side plate portion 2*c* through a connecting portion 2*h*. The holding member 6 comprises a flat plate-like base portion 6*a*, a semi-cylindrical embracing portion 6*b* formed centrally of the base portion 6*a*, and a generally <-shaped retaining piece 6*c* formed by being bent on a free end side of the base portion 6*a*.

The holding member 6 can be bent from the side plate portion 2*c*. When the holding member 6 is bent so as to become opposed to the side plate portion 2*d*, the retaining piece 6*c* can be engaged with the engaging hole 3.

As best seen in FIG. 1, short-circuit wall 7, which is formed in a box shape using a thin metallic plate, comprises a lid portion 7*a* connected to the side wall 1*d* of the housing 1 and formed by being bent at right angles from the side wall 1*d*, side portions 7*b*, 7*c* and 7*d* formed by being bent downward on the side opposed to the side wall 1*d*, and a cavity 7*e* (see FIG. 2) enclosed with the lid portion 7*a*, side portions 7*b*–7*d* and side wall 1*d*.

The short-circuit wall 7 is positioned within the housing 1 so that its cavity 7*e* is opposed to the hollow portion 2*e* of the waveguide 2.

As shown in FIG. 6, a probe 8 for catching a horizontally polarized wave is made up of a cylindrical L-shaped insulating portion 8*a* formed of, for example, a fluorine resin, polyethylene or Teflon and a linear central conductor 8*b* formed mainly using such a metal as brass or nickel and piercing through a central part of the insulating portion 8*a*. The central conductor 8*b* has one end portion 8*c* which is bent at right angles together with the insulating portion 8*a* and an opposite end portion 8*d* positioned perpendicularly to the one end portion 8*c*.

As shown in FIG. 7, one end portion of the L-shaped insulating portion 8*a* of the probe 8 is fitted into the circular hole 4*a* as a constituent of the insertion hole 4 formed in the side plate portion 2*d* of the waveguide 2, while the opposite end portion of the insulating portion 8*a* exposed from the waveguide 2 is held while being gripped by both an outer surface of the side plate portion 2*d* of the waveguide and the embracing portion 6*b* of the holding member 6. At this time, the opposite end portion of the insulating portion 8*a* exposed from the waveguide 2 is covered with the embracing portion 6*b* of the holding member 6 throughout the whole thereof in its longitudinal direction and so is the central conductor 8*b* exposed from the waveguide 2.

When the probe 8 is mounted, the opposite end portion 8*d* of the central conductor 8*b* projects to the housing 1 side, while the bent one end portion 8*c* projects to a central part of the hollow portion 2*e* of the waveguide 2.

As shown in FIG. 5, a rectangular circuit board 9, which is formed by a single insulating board, comprises a thin flat plate portion 9*a*, a cutout portion 9*b* formed in one side edge of the flat plate portion 9*a*, three generally rectangular, vertical through holes 9*c* formed near the cutout portion 9*b*, bridge portions 9*g* and 9*h* defined in T shape by the through holes 9*c*, a small hole 9*d* formed near the through holes 9*c*, two first engaging holes 9*e* formed in positions near the through holes 9*c* and opposed to the cutout portion 9*b*, and a plurality of second engaging holes 9*f* formed in marginal positions of the flat plate portion 9*a*. A copper-clad earth conductor 10 is formed on a lower surface of the flat plate portion 9*a* throughout the whole of the lower surface exclusive of the bridge portion 9*h*.

A probe 11 for catching a vertically polarized wave is formed by a conductive pattern on an upper surface of the bridge portion 9*h* so as to extend from an intersecting point of the bridge portions 9*g* and 9*h* up to the flat plate portion 9*a* of the circuit board 9 and is connected to a wiring pattern (not shown) formed on an upper surface of the flat plate portion 9*a*. A band-like earth pattern 12 is formed by copper cladding on the upper surface of the flat plate portion 9*a* so as to surround the through holes 9*c* and in a connected state with the earth conductor 10 through a plurality of through holes 12*a* formed through the circuit board 9.

The upper surface of the flat plate portion 9*a* of the circuit board 9 thus constructed is brought into abutment against lower ends of the side walls 1*a*-1*d* and the circuit board 9 is held grippingly by both the side wall lower ends and the end portions 2*f* of the waveguide 2 against which a lower surface of the flat plate portion 9*a* is in abutment. In this state, the retaining pieces 2*g* of the waveguide 2 and the first engaging holes 9*e* formed in the circuit board 9 are engaged with each other and the engaging pieces 1*f* of the housing 1 and the second engaging holes 9*f* formed in the circuit board are also engaged with each other to effect holding of the circuit board.

In this case, the upper surface of the flat plate portion 9*a* of the circuit board 9 comes into abutment against lower ends of the side portions 7*b*–7*d* of the short-circuit wall 7 and the side plate portion 2*a* of the waveguide 2 is fitted in the cutout portion 9*b* of the flat plate portion 9*a*.

Further, as shown in FIG. 3, the through holes 9*c* formed in the circuit board 9 is opposed to the hollow portion 2*e* of the waveguide 2 and the cavity 7*e* of the short-circuit wall 7, the side portions 7*b*–7*d* of the short-circuit wall 7 are abutted against the earth pattern 12, and the opposite end portion 8*d* of the central conductor 8*b* in the probe 8 is inserted through the hole 9*d* formed in the flat plate portion 9*a*. The opposite end portion 8*d* of the central conductor 8*b* projecting above the circuit board 9 is soldered by solder 13 and is connected to a wiring pattern formed on the circuit board.

Thus, the through holes 9*c* formed in the circuit board 9 are positioned inside the waveguide 2 and also inside the short-circuit wall 7 and a lower surface of the circuit board except the through holes 9*c* is shielded by the earth conductor 10.

As best seen in FIGS. 1 and 2, an L-shaped cover 14 is constituted by a single rectangular metallic plate, and is fitted in a fitting portion constituted by both side wall 1*d* and upper wall 1*e* of the housing 1 and is fixed by a suitable means. In this way the interior of the housing 1 is put in a hermetically sealed and electrically shielded state.

The converter for satellite broadcast reception according to the present invention is constructed as above. Now, a description will be given about how to assemble the converter. First, as shown in FIG. 4, the housing 1 which comprises the upper wall 1*e* formed with the central hole 1*g* and the cutout portion 1*h* and the side walls 1*a*, 1*b*, 1*c*, 1*d* extending on all sides from the upper wall 1*e*, the waveguide 2 which is formed outside the housing 1 and which comprises the side plate portion 2*a* extending from the side wall 1*d*, the side plate portions 2*b* and 2*c* extending contiguously from one side of the side plate portion 2*a*, the side plate portion 2*d* extending from the opposite side of the side plate portion 2*a*, and the holding portion 6 extending outward from the side plate portion 2*c* through the connecting portion 2*h*, and the short-circuit wall 7 which comprises the lid portion 7*a* extending from the side wall 1*d* opposedly to the side plate portion 2*a* and the side portions 1*b*–7*d* extending in three directions from the lid portion 7*a*, the short-circuit wall 7 spanning both hole 1*g* and cutout portion 1*h* of the housing 1, are formed as a semi-finished product 15 by punching a thin metallic plate.

In the semi-finished product 15, by bending the side walls 1*a*–1*d* at right angles in the respective positions indicated with dotted lines A, there is formed the housing 1. Likewise, by bending the side plate portions 2*b*–2*d* at right angles in the respective positions indicated with dotted lines B and connecting the side plate portions 2*c* and 2*d* with each other, there is formed the waveguide 2. Further, by bending the lid portion 7*a* at right angles in the position of a dotted line C and by bending the side portions 7*b*–7*d* in the positions of dotted lines D, there is formed the short-circuit wall 7. As a result, there is formed such an entire shape as shown in FIG. 1.

The following description is now provided about how to install the circuit board 9. As shown in FIG. 2, the waveguide 2 suspended vertically from the housing 1 is tilted outward from the bending facilitating means 5 as indicated with a dotted line, allowing the circuit board 9 to be positioned between the housing and the waveguide, and thereafter the waveguide 2 is restored to its vertical state to pinch the circuit board 9 between the housing 1 and the waveguide 2. This pinching operation is performed by first mounting the circuit board 9 to the underside of the housing 1 while fitting the engaging pieces 1*f* of the housing 1 into the second engaging holes 9*f* formed in the circuit board and by subsequently bringing the retaining pieces 2*g* formed on a free end-side end portion 2*f* of the waveguide 2 into engagement with the first engaging holes 9*e* formed in the circuit board 9, as shown in FIG. 3. The circuit board 9 is pinched and held firmly by such engagements.

Next, the probe 8 is fitted in the insertion hole 4 by turning the probe in the direction of arrow from its state shown in FIG. 6 until the one end portion 8*c* of the central conductor 8*b* is positioned within the hollow portion 2*e* and by allowing the insulating portion 8*a* to be engaged in the circular hole 4*a*. Next, the holding portion 6 is bent from the connecting portion 2*h* and the retaining piece 6*c* formed on a free end side of the holding portion 6 is locked to the engaging hole 3, thereby holding the insulating portion 8*a* grippingly between the embracing portion 6*b* and the side plate portion 2*d* and so holding the probe 8.

Reference will now be made to the operation of the converter for satellite broadcast reception thus formed and assembled according to the present invention. Two polarized waves orthogonal to each other are introduced through the waveguide 2 into the hollow portion 2*e* of the waveguide. Of the two polarized waves, a horizontally polarized wave is reflected by a part of the earth conductor 10 formed on the back of the bridge portion 9*g* and is caught by the one end portion 8*c* of the probe 8 projecting into the hollow portion 2*e*, while a vertically polarized wave is reflected by the lid portion 7*a* of the short-circuit wall 7 and is caught by the probe 11 formed on the upper surface of the bridge portion 9*h*. The horizontally polarized wave caught by the probe 8 is transmitted as a horizontal polarization signal to an electric circuit on the circuit board 9 through the central conductor 8*b*.

The vertically polarized wave caught by the probe 11 is transmitted as a vertical polarization signal to the electric circuit on the circuit board 9, which circuit in turn combines the polarization signals transmitted from the probes.

Figure 10:
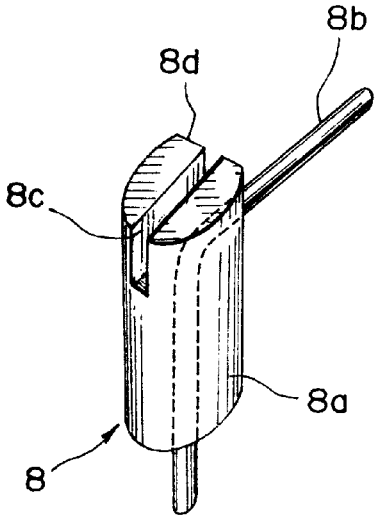
FIG. 10 is a perspective view of a probe used in a converter for satellite broadcast reception according to the second embodiment of the present invention.
Figure 11:
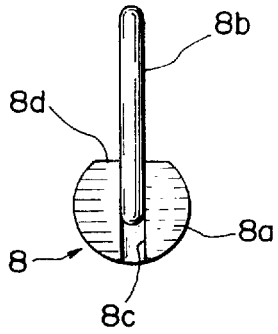
FIG. 11 is a plan view thereof.
Figure 12:
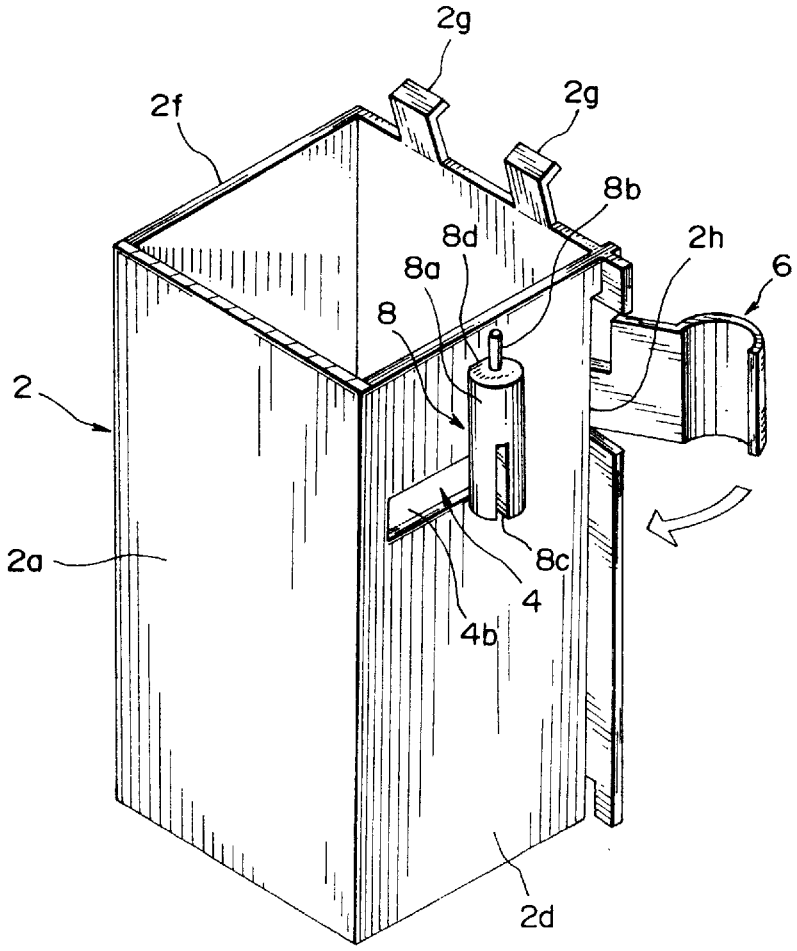
FIG. 12 is a perspective view showing in what state the probe is mounted.
Figure 13:
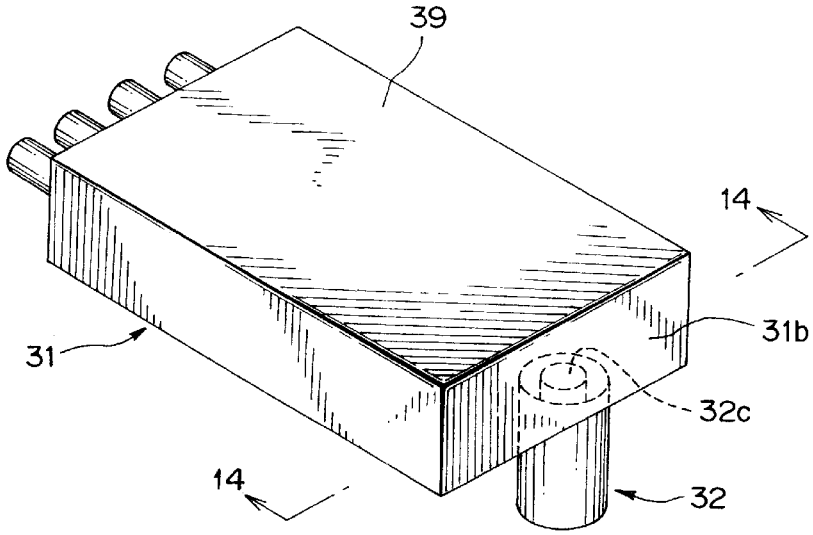
FIG. 13 PRIOR ART
FIG. 13 is a perspective view of a conventional converter for satellite broadcast reception.
Figure 14:
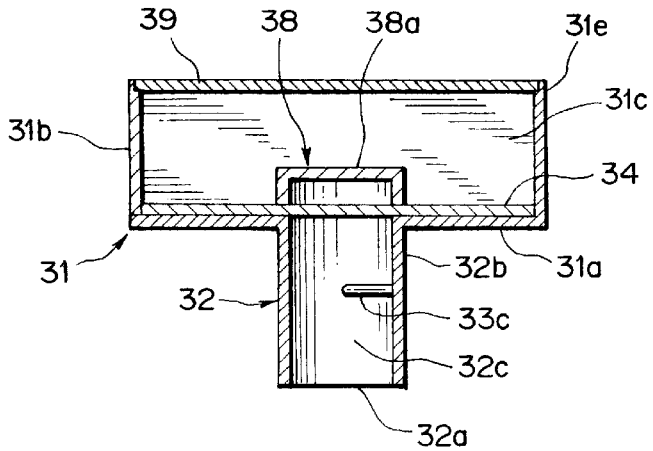
FIG. 14 PRIOR ART
FIG. 14 is a sectional view taken on line 14—14 in FIG. 13.
Figure 15:
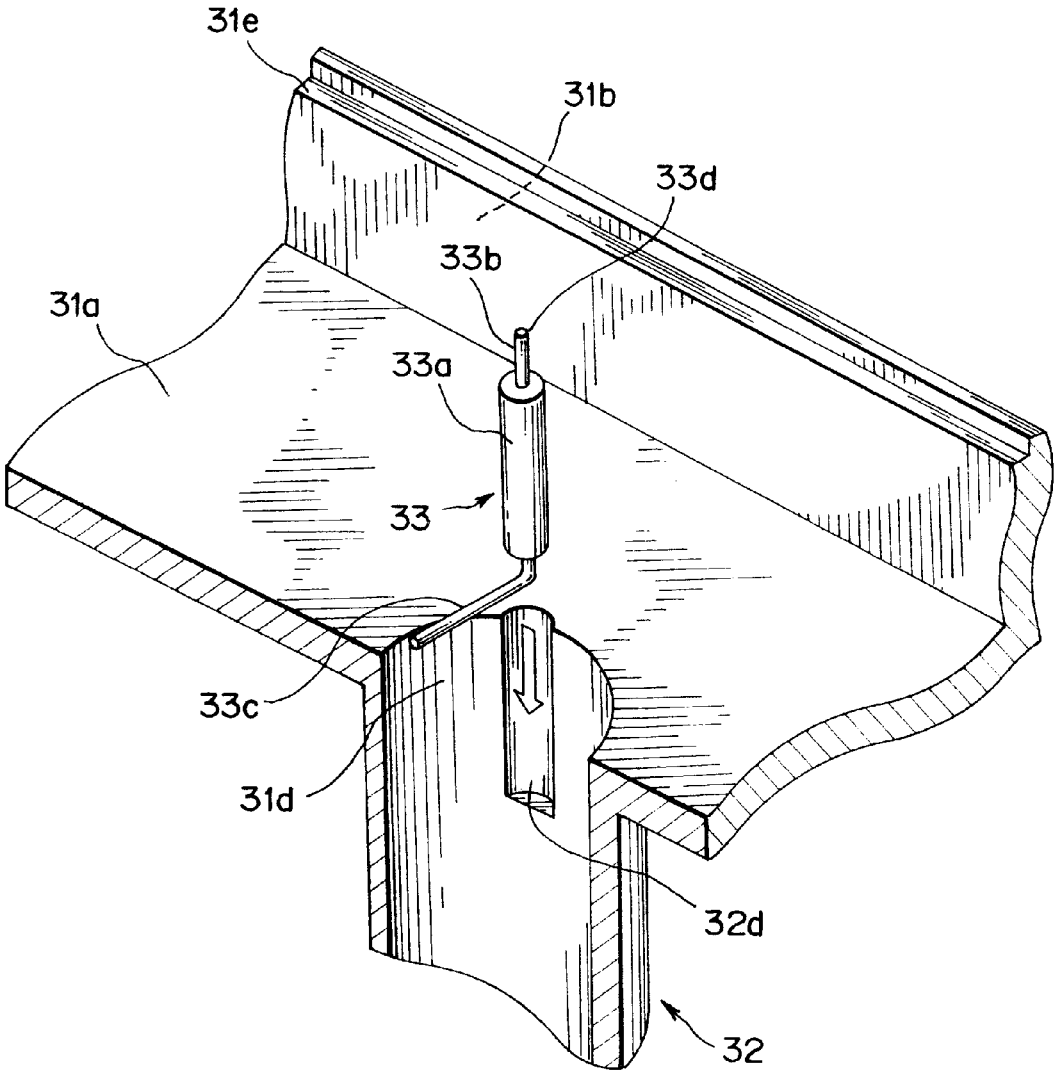
FIG. 15 PRIOR ART
FIG. 15 is an enlarged view of a principal portion, showing in what state a probe is mounted in the conventional converter.
Figure 16:
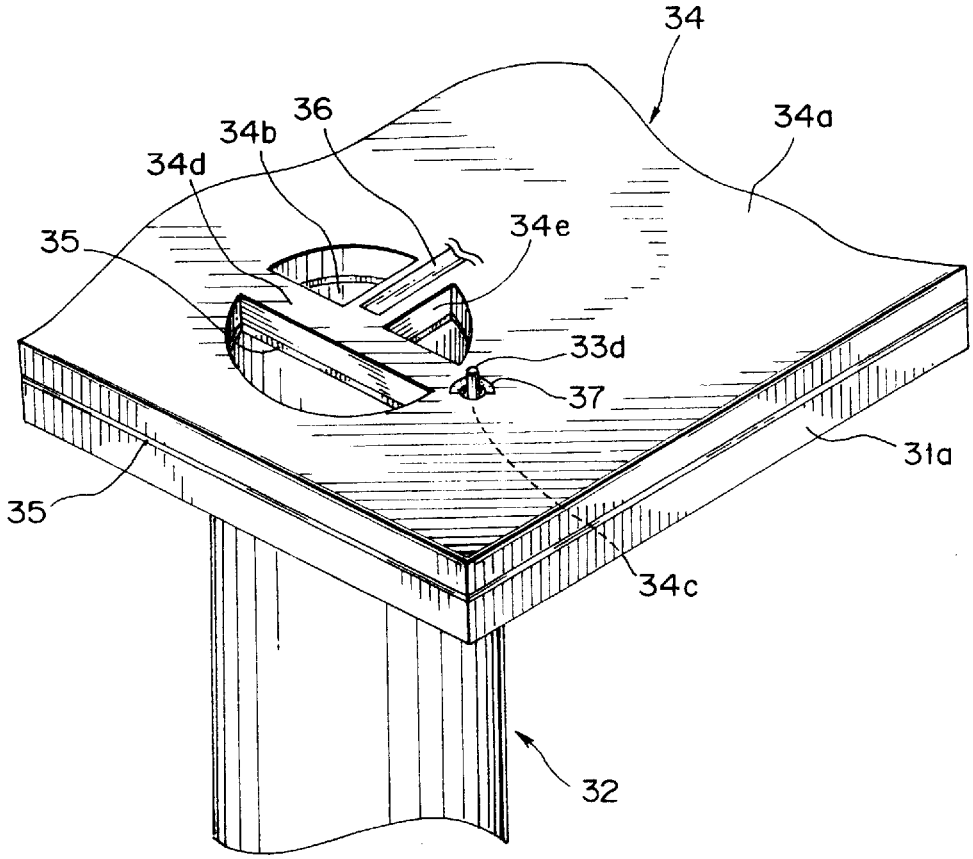
FIG. 16 PRIOR ART
FIG. 16 is an enlarged view of a principal portion, showing in what state a circuit board is mounted in the conventional converter.

FIGS. 10 to 12 illustrate a converter for satellite broadcast reception according to the second embodiment of the present invention, of which FIG. 10 is a perspective view of a probe used in the converter, FIG. 11 is a plan view thereof, and FIG. 12 is a perspective view showing in what state the probe is mounted in the converter.

Now, with reference to FIGS. 10 to 12, a description will be given about the configuration of the converter for satellite broadcast reception according to the second embodiment. An insulating portion 8*a* of a probe 8 has a slot 8*c* formed longitudinally and a flat surface 8*d* formed on an outer surface of the insulating portion.

A central conductor 8*b* is press-fitted into the insulating portion 8*a* and one end thereof is bent at right angles along the slot 8*c* and is projected outward from the slot. The flat surface 8*d* is formed at a position perpendicular to the extending direction of the bent one end of the central conductor 8*b*.

As shown in FIG. 12, in the probe 8 thus constructed, the bent one end of the central conductor 8*b* is inserted into the insertion hole 4 of the waveguide 2 and the flat surface 8*c* of the insulating portion 8*a* is placed on an outer surface of the waveguide 2 in such a manner that the insulating portion 8*a* straddles the insertion hole 4. In this state, a holding portion 6 is bent to push the insulating portion 8*a* against the outer surface of the waveguide 2, whereby the probe 8 is mounted.

It goes without saying that the present invention is not limited to the converters for satellite broadcast reception of the above embodiments. As shown in FIG. 8, the holding portion 6 may be in a bent state from the connecting portion 2*h*, not having a retaining piece, and the insulating portion 8*a* may be held by such a holding portion. The holding portion 6 may be formed as in FIG. 9, in which the insulating portion 8*a* is embraced and held substantially throughout the whole circumferential surface thereof by only the holding portion 6.

The bending facilitating means 5 is not limited to such a cut-in portion as referred to in the above embodiments, but it may be perforations.

In the converter for satellite broadcast reception according to the present invention, as set forth above, the waveguide is formed by bending a metallic plate and is integrally provided with a holding portion which is positioned outside the waveguide, and an insulating portion of a probe is held by the holding portion. Therefore, the probe can be held easily by the waveguide and hence it is possible to improve the productivity.

Besides, since the waveguide is constituted by a single thin metallic plate, it is not necessary to use a mold and the material cost is reduced, thus permitting the provision of a less expensive converter for satellite broadcast reception.

Since the insulating portion of the probe is held in a pinched state by both an outer surface of the waveguide and the holding portion, it is possible to hold the probe positively and hence possible to provide a more reliable converter for satellite broadcast reception.

Since the holding portion is provided with a retaining piece for locking a free end side of the holding portion to the waveguide, the probe can be held in a simple and positive manner and the free end of the holding portion can be fixed surely to the waveguide, thus making it possible to provide a converter for satellite broadcast reception with no likelihood of reversion of the holding portion from its bent state.

Since the holding portion covers the probe throughout the whole in the longitudinal direction of the insulating portion exposed from the waveguide, the probe can be held positively and it is possible to provide a highly reliable converter for satellite broadcast reception.

Since the holding portion covers the probe throughout the whole in the longitudinal direction of the central conductor exposed from the waveguide, not only the holding portion functions to shield the probe but also it makes the probe difficult to be deformed against an external force, thus permitting the provision of a converter for satellite broadcast reception which is little deformed.

Since the insulating portion with the central conductor installed therein is formed with a longitudinal slot and one end portion of the central conductor is bent along the slot, bending of the central conductor can be done uniformly and it is possible to provide a converter for satellite broadcast reception which permits an accurate bending.

Since the outer surface of the insulating portion is formed with a flat surface perpendicular to the extending direction of one end of the central conductor and the probe is held by the holding portion in an abutted state of the flat surface against the outer surface of the waveguide, the insulating portion and the central conductor can be installed accurately and it is possible to provide a converter for satellite broadcast reception superior in assemblability.

Since the waveguide is formed with an insertion hole for insertion therein of the central conductor and in an inserted state of the central conductor into the insertion hole the insulating portion is rested on the outer surface of the waveguide so as to straddle the insertion hole, the insulating portion can be stably rested on the outer surface of the waveguide and it is possible to provide a converter for satellite broadcast reception with the probe installed therein firmly.

What is claimed is:

1. A converter for satellite broadcast reception, comprising:

a box-shaped metallic housing;

a cylindrical waveguide; and a probe attached to said waveguide, said probe having a cylindrical insulating portion and a central conductor piercing through a central part of said insulating portion, said waveguide being a bent metallic plate and being integrally provided with a holding portion positioned opposite to an outer surface of the waveguide to hold said insulating portion of said probe in a state in which it is held by the outer surface of said waveguide and said holding portion.

2. A converter for satellite broadcast reception according to claim 1, wherein said insulating portion with said central conductor installed therein comprises a slot in the longitudinal direction thereof, and one end portion of the central conductor is bent along said slot.

3. A converter for satellite broadcast reception according to claim 1, wherein said holding portion is provided with a retaining piece for locking a free end side of the holding portion to said waveguide.

4. A converter for satellite broadcast reception according to claim 1, wherein said holding portion covers said probe over the entire longitudinal direction of said insulating portion which is exposed from the outer surface of said waveguide.

5. A converter for satellite broadcast reception according to claim 1, wherein said holding portion covers said probe over the entire longitudinal direction of said central conductor which is exposed from the outer surface of said waveguide.

6. A converter for satellite broadcast reception according to claim 1, wherein an outer surface of said insulating portion includes a flat surface, and said probe is held by said holding portion in an abutted state of said flat surface against an outer surface of said waveguide.

7. A converter for satellite broadcast reception according to claim 6, wherein said flat surface, which comprises a part of the outer surface of said insulating portion, is perpendicular to an extending direction of one end of said central conductor, and said probe is held by said holding portion in an abutted state of said flat surface against the outer surface of said waveguide.

8. A converter for satellite broadcast reception according to claim 7, wherein an insertion hole for insertion therein of said central conductor is disposed in said waveguide, and with the central conductor inserted into said insertion hole, said insulating portion is placed on the outer surface of the waveguide so as to straddle the insertion hole.

* * * * *